US006488514B2

(12) United States Patent
Kubo et al.

(10) Patent No.: US 6,488,514 B2
(45) Date of Patent: Dec. 3, 2002

(54) ELECTRICAL CONNECTORS EQUIPPED WITH GUIDING COLUMN AND GUIDING APERTURE, RESPECTIVELY

(75) Inventors: Akira Kubo, Tokyo (JP); Yasuhiro Enami, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/906,620

(22) Filed: Jul. 18, 2001

(65) Prior Publication Data

US 2002/0013075 A1 Jan. 31, 2002

(30) Foreign Application Priority Data

Jul. 19, 2000 (JP) ..... 2000-218879

(51) Int. Cl.[7] ..... H01R 13/648
(52) U.S. Cl. ..... 439/108; 439/924.1
(58) Field of Search ..... 439/101, 108, 439/570, 608, 924.1

(56) References Cited

U.S. PATENT DOCUMENTS

RE35,508 E * 5/1997 Lemke et al. ..... 439/101
5,919,063 A * 7/1999 Wang ..... 439/608
6,007,352 A * 12/1999 Azuma et al. ..... 439/108

* cited by examiner

*Primary Examiner*—Khiem Nguyen
(74) *Attorney, Agent, or Firm*—Kanesaka & Takeuchi

(57) ABSTRACT

An electrical connector equipped with a guiding column comprises a housing (21); at least one guiding column (23) extending forwardly from the housing (21) to be inserted into a guiding aperture (14B) of a mating connector (10); at least one ground terminal (24) having a contact section (24A) for contact with a ground member (12) of the mating connector (12); and a side recess (23B) provided in the guiding column (23) to receive the ground terminal (24) such that the contact section (24A) of the ground terminal (24) projects from the side recess (23B) for making sliding contact with the ground member (12) of the mating connector (10).

6 Claims, 14 Drawing Sheets

ELECTRICAL CONNECTORS EQUIPPED WITH GUIDING COLUMN AND GUIDING APERTURE, RESPECTIVELY

BACKGROUND OF THE INVENTION

1. Field of the Invention

The present invention relates to electrical connectors and, particularly, to an electrical connector equipped with a ground terminal.

2. Description of the Related Art

Japanese patent application Kokai No. 10-255906 discloses an electrical connector of this type. This connector is shown in FIG. 14 for facilitating understanding.

In FIG. 14, a connector 60 has a ground pin terminal 61. The pin terminal 61 is made by machining a metallic material so as to provide a threaded section 62. A housing 63 has a receiving section 64 for receiving the threaded section 62. A ground terminal 65 is provided in the receiving section 64 and having a fixing flange 65A, a threaded tube 65B, and a connecting section 65C extending from the fixing flange 65A in an L-shaped form. Such a connector 60 is attached to a circuit board P1 and the connecting section 65C is connected to a corresponding section with a solder 66.

A mating connector 70 comprises a housing 71 having a ground terminal 72 that has a fixing flange 72A secured to the housing 71, a threaded tube 72B, and a connecting section 72C extending from the fixing flange 72A in an L-shaped form. A bush 73 has a threaded section 73A screwed into the threaded tube 72B, an intermediate section with a window 73B provided above the threaded section 73A, and an enlarged head section 73C above the intermediate section. The connector 70 is attached to a panel 74 by screwing the bush 73 into the ground terminal 72 so that the panel 74 is held between the housing 71 and the head section 73C. A hollow section is provided in the intermediate section and the head section 73C of the bush 73 for receiving the pin terminal 61. A U-shaped contact member 75 is provided on the bush 73 and has a contact section 75A slightly projecting from the window 73B into the hollow portion.

Similarly to the above connector 60, the connector 70 is attached to a circuit board P2 and the connecting section 72 is soldered to a corresponding section with a solder 76.

When the connector 60 is plugged into the connector 70, the pin terminal 61 enters the hollow portion of the bush 73 and makes contact with the contact section 75 and the threaded section 73A so that it is grounded through the ground terminal 72.

However, the above connector has several disadvantages about grounding.

First of all, the number of parts or components is very large. The connector 60 requires both the ground terminal 65 and the pin terminal 61 for grounding while the connector 70 needs the bush 73, the contact piece 75, and the ground terminal 72. The structures of these components are very complicated. The ground terminals 65 and 72 for the connectors 60 and 70 require threaded tubes 65B and 72B, respectively. The bush 73 for the connector 70 has the three stepped sections, the window section 73B, and the threaded section 73A below the head section 73C. The contact piece 75 requires complex press working so as to adapt for the pin terminal 61 of the connector 60.

Consequently, not only the manufacturing cost is high but also the connector becomes large. Also, the assembling becomes complex, and the electrical resistance can be high and the contact can be unstable. The pin terminal for contact with the ground terminal must be made of a metal material, which requires machining for providing the required shape and size, resulting in the increased cost.

SUMMARY OF THE INVENTION

Accordingly, it is an object of the invention to provide a compact electrical connector having simpler shape and structure and lower cost than ever before.

According to the invention there is provided an electrical connector equipped with a guiding column, which comprises a housing; at least one guiding column extending forwardly from the housing to be inserted into a guiding aperture of a mating connector; at least one ground terminal having a contact section for contact with a ground member of the mating connector; and a side recess provided in the guiding column to receive the ground terminal such that the contact section of the ground terminal projects from the side recess for making sliding contact with the ground member of the mating connector.

Since the ground terminal is provided within the guiding column, a compact connector is obtained. The ground terminal is made of a metal strip so that it is possible to reduce the manufacturing cost.

The guiding column may be made integrally with the housing as a unit and the ground terminal may have a connection section at the rear end so that the terminals are provided close to the guiding column, making the structure simpler and the connector smaller than before. The guiding column may be made of a metallic material and supported by the housing so as to make contact with the ground terminal and have a connection section at the rear end.

Where the shield case is attached to the housing, it is preferred that the ground terminal be made integrally with the shield case as a unit. Also, it is preferred that the guiding column be made of a metallic material so as to make contact with the shield case.

According to another aspect of the invention there is provided an electrical connector to be plugged with a connector equipped with a guiding column, which comprises a housing having an attaching face to be attached to a circuit board and a guiding aperture for receiving said guiding column; a ground member provided in said guiding aperture for sliding contact with a ground terminal of said guiding column-equipped connector; and an extended section extending from said ground member by a distance no greater than a thickness of said circuit board.

The guiding column is guided by the guiding aperture longer than before by a distance substantially equal to the thickness of the circuit board so that the contact between the ground member and the ground terminal of the mating connector is made more stable than before and the connector can be made compact by the presence of the extended section, which extends into the circuit board.

DESCRIPTION OF THE PREFERRED EMBODIMENTS

Embodiments of the invention will now be described with reference to FIGS. 1–11.

Figure 1:
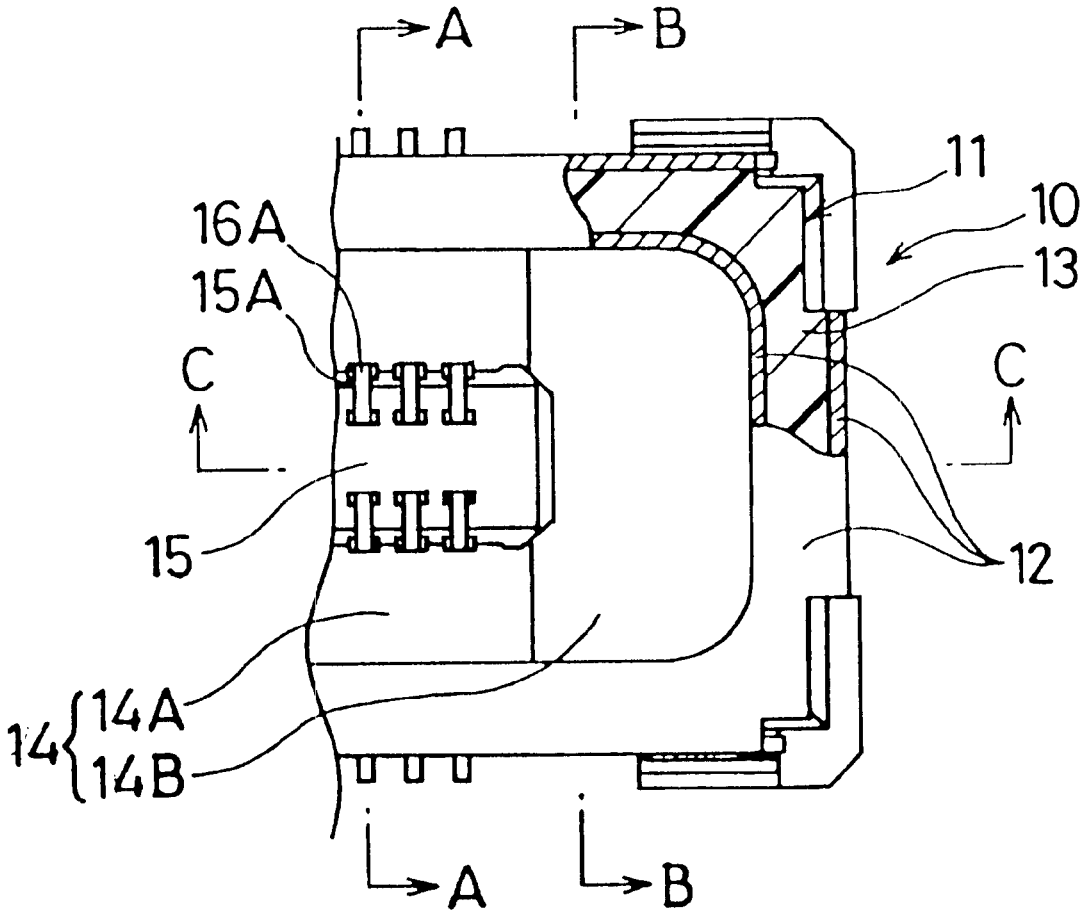
FIG. 1 is a plan view of part of an electrical connector according to an embodiment of the invention.
Figure 2A:
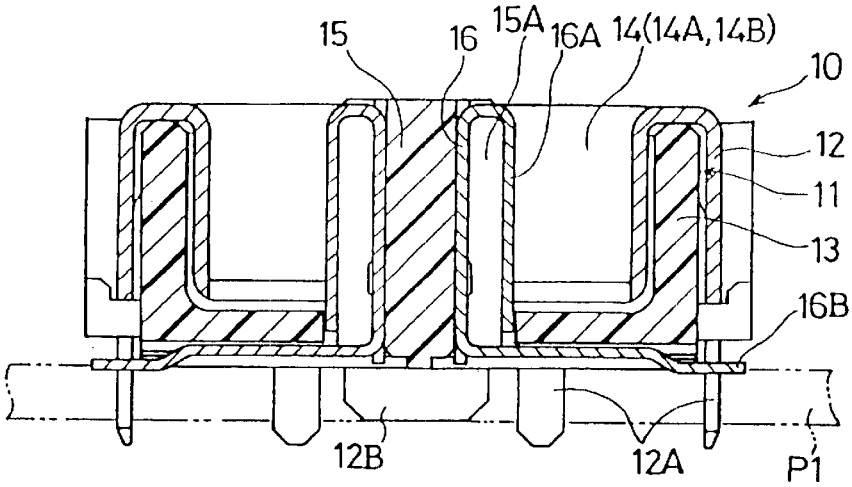
FIGS. 2(A)–(C) are sectional views taken along lines A—A, B—B, and C—C of FIG. 1, respectively.
Figure 2B:
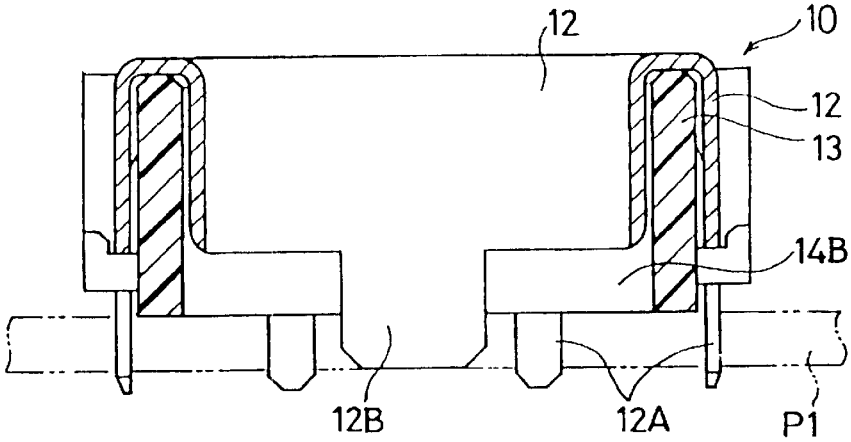
Figure 2C:
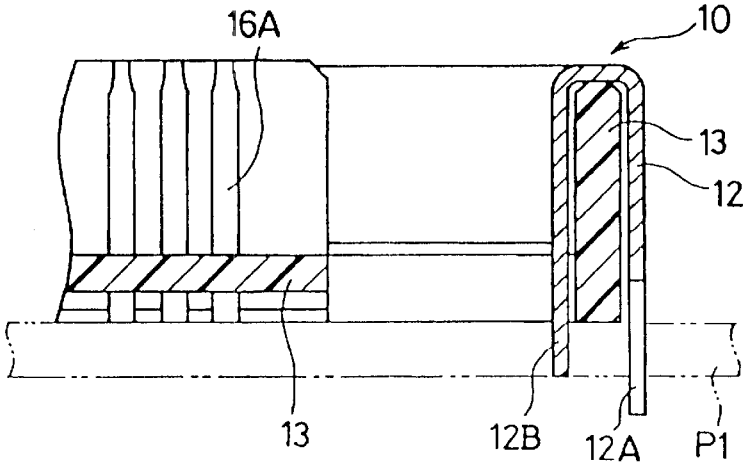

In FIGS. 1–2(C), a connector 10 comprises a substantially rectangular housing 11 made of an insulative material and a shield case 12 made of a metal sheet and attached over the housing 11. The housing has a circumferential wall 13 to define a receiving cavity 14 for receiving a mating connector. The receiving cavity 14 consists of a pair of plugging recesses 14A and a pair of guiding apertures 14B.

The inner and outer faces of the circumferential wall 13 are covered by the shield case 12 with a U-shaped section. A plurality of attaching legs 12A extend downwardly from the outer face of the shield case 12. They are inserted through apertures in a circuit board P1 and soldered on the lower face of the circuit board P1. A pair of tongue sections 12B extend downwardly from the inner face of the circumferential wall 13 through the guiding apertures 14. When the connector 10 is mounted on the circuit board P1, the tongue sections 12B reach the lower face of the circuit board P1 through apertures in the circuit board P1 that are provided corresponding to the guiding apertures 14.

An arranging plate 15 is provided at the center of the receiving section 14. A plurality of grooves 15A are provided in either face of the arranging plate 15 in which the contact sections 16A of (signal) terminals 16 are arranged. As shown in FIG. 2(A), a leg of the U-shaped portion of each contact section 16A slightly project from the groove 15A and is flexible. The free end of the L-shaped portion forms a connection portion 16B extending along the bottom of the housing 11. When the connector 10 is placed on the circuit board P1, the connection portion 16B makes contact with a corresponding circuit trace of the circuit board P1 for soldering.

Figure 3:
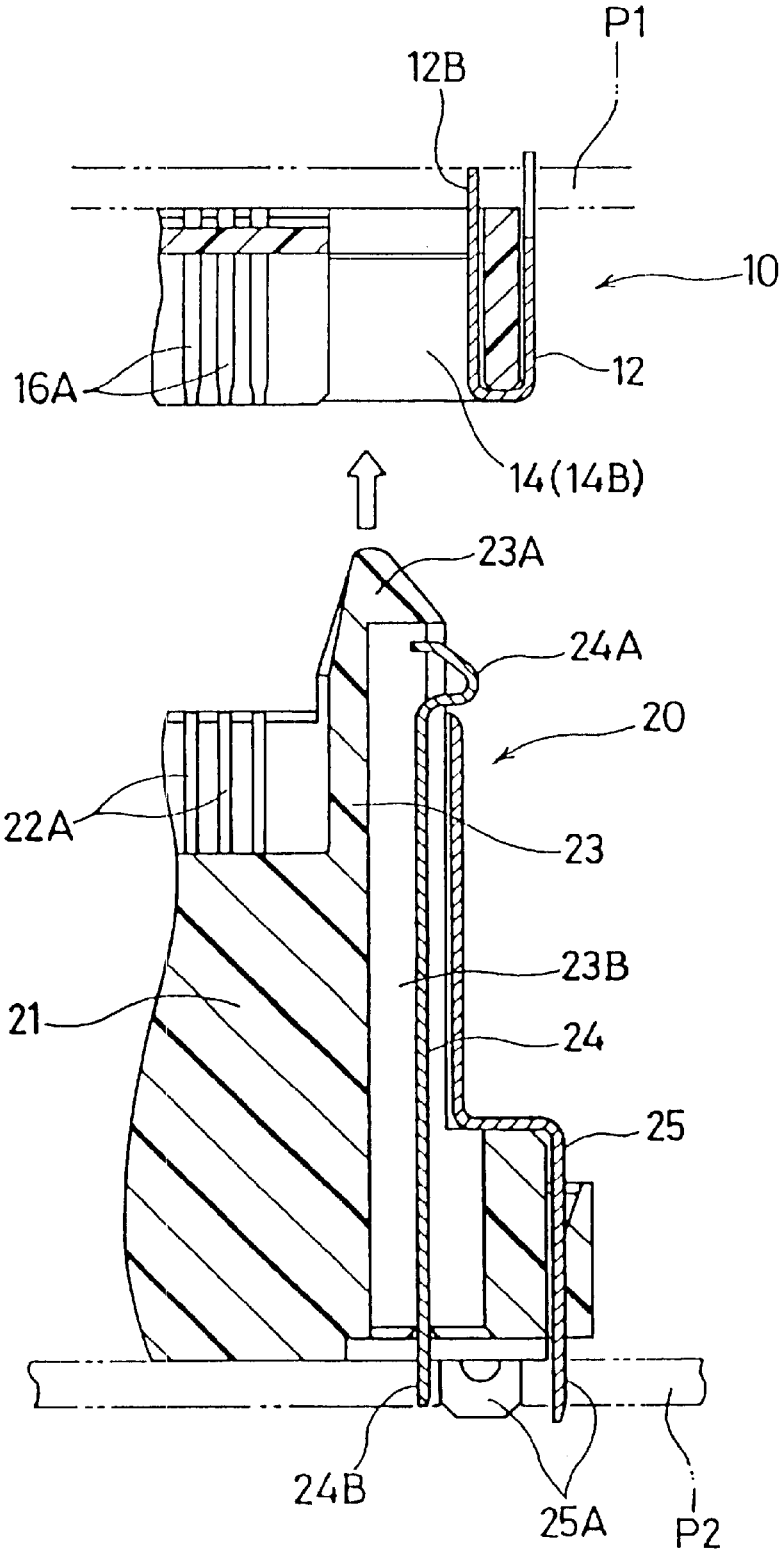
FIG. 3 is a sectional view of part of the electrical connector and another electrical connector prior to plugging.

In FIG. 3, another connector 20 to be plugged into the connector 10 comprises a housing 20 and a plurality of (signal) terminals 22 provided on the housing 20. Each terminal 22 has a contact section 22A that makes contact with the contact section 16A of a terminal 22 when the connector 20 is plugged into the connector 10. A pair of guiding columns 23 are provided on the housing 21 to fit into the guiding apertures 14B, assuring the correct plugging relationship between both the connectors 10 and 20. Each guiding column 23 extends forwardly from the housing 21 and has a tapered head 23A. It is provided with a side recess 23B to receive a ground terminal 24 that is made of a metal strip and flexible. The ground terminal 24 has a contact bend 24A that projects from the side recess 23B and a connection portion 24B at the other end. When the connectors 10 and 20 are plugged together, the contact section 24A slides on the tongue portion 12B of the shield case 12 up to the rear end. When the connector 20 is placed on a circuit board P2, the connection portion 24B goes through a corresponding aperture of the circuit board and is soldered to a corresponding circuit trace on the lower face of the circuit board.

A shield case 25 covers the outside face of the housing 21. When the connectors 10 and 20 are plugged together, it makes contact with at least part of the shield case 12 for electrical connection. It has a connection leg 25A that goes through an aperture of the circuit board P2 and is soldered to a corresponding circuit trace on the lower face of the circuit board.

The connectors 10 and 20 are plugged together as follows.

Figure 4:
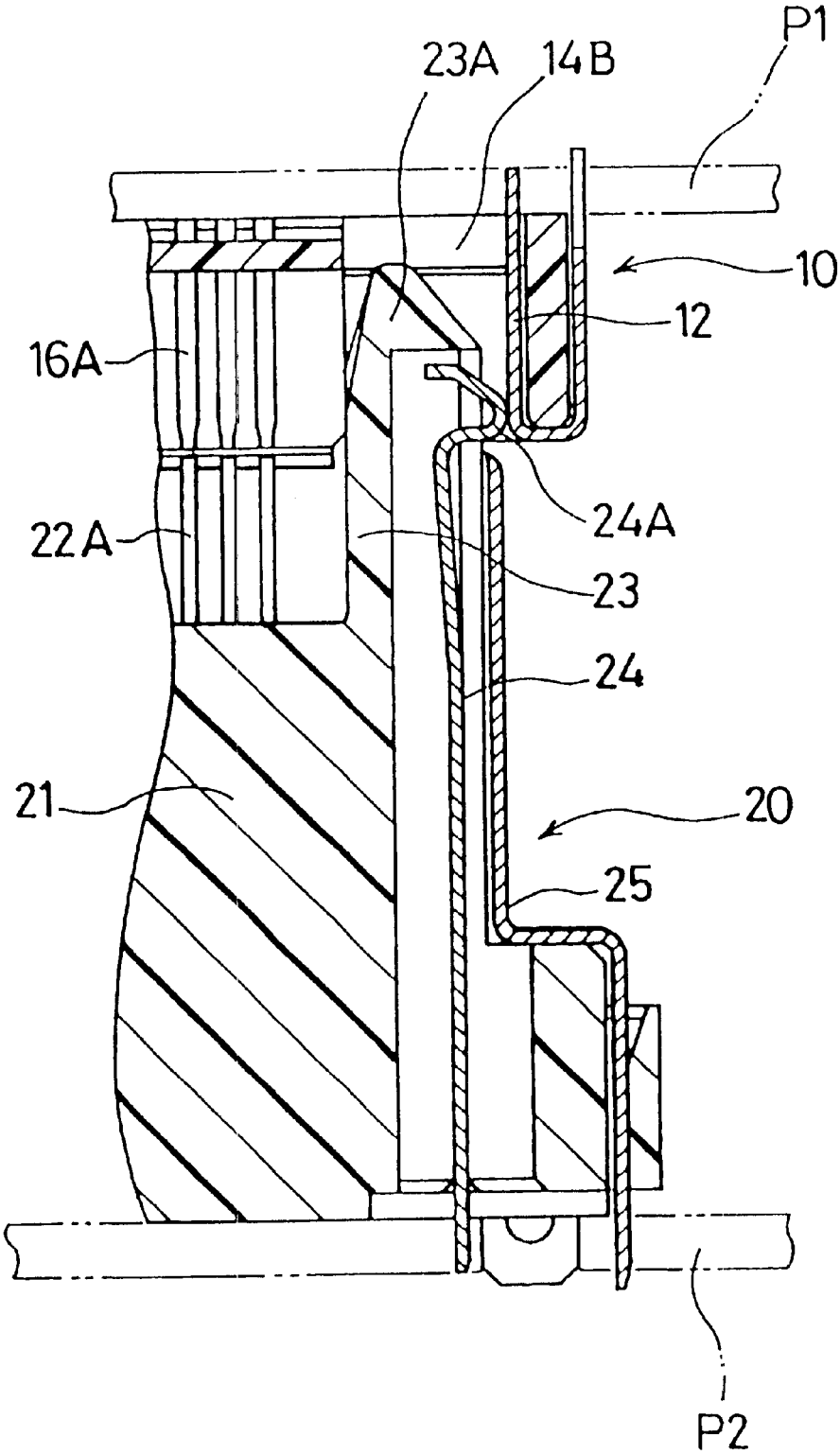
FIG. 4 is a sectional view of the electrical connectors when plugging begins.
Figure 5:
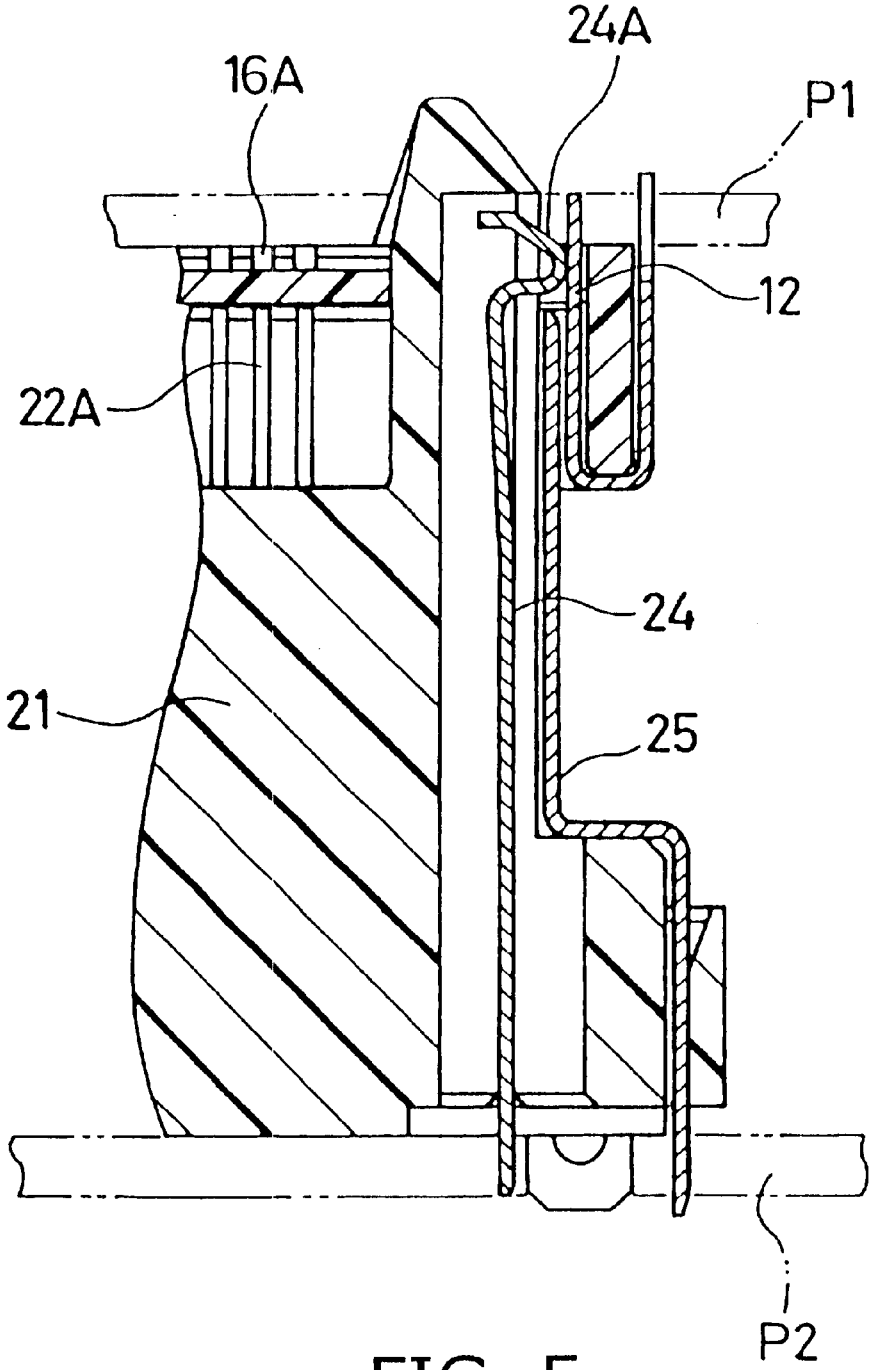
FIG. 5 is a sectional view of the electrical connectors when plugging is completed.

(1) The connectors 10 and 20 attached to the circuit boards P1 and P2, respectively, are placed as shown in FIG. 3 and, then, the head portions 23A of the guiding columns 23 for the connector 20 are put into the guiding apertures 14B of the connector 10 as shown in FIG. 4.

(2) The contact sections 24A of the ground terminals 24 make contact with the ground member or shield case 12 of the connector 10 before the contact sections 16A and 22A of the signal terminals 16 and 22 for the connectors 10 and 20 come to contact.

(3) When the connectors 10 and 20 reach the plug completion position, the contact sections 24A of the ground terminals 24 reach the rear ends of the tongue portions 12B of the shield case 12. At this point, the contact sections 16A and 22A of the connectors 10 and 20 are in contact with each other. The shield case 12 and 25 do not appear to be in contact in FIG. 5 but they are in contact with each other on faces parallel to the drawing sheet. The faces perpendicular to the drawing sheet may also be made contact with each other.

Figure 6:
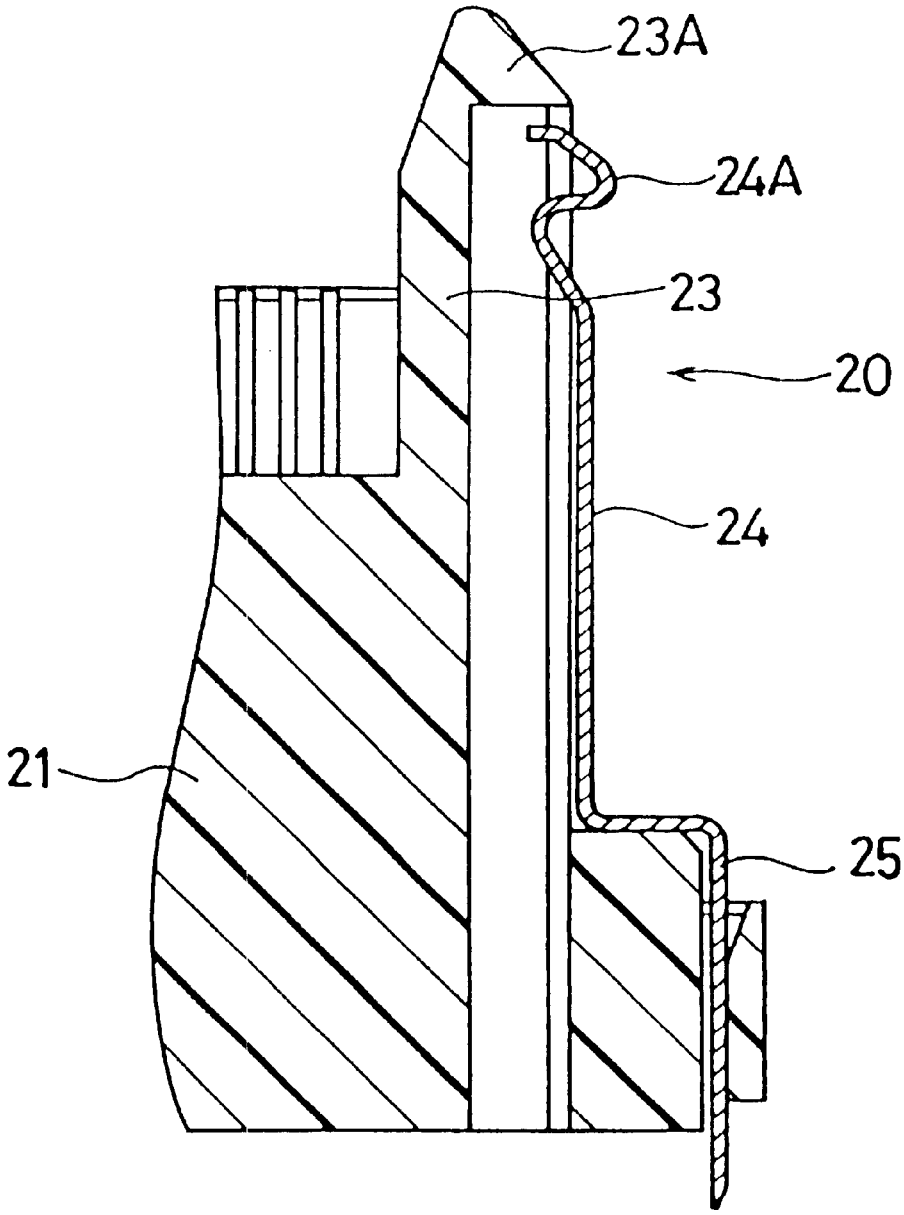
FIG. 6 is a sectional view of part of an electrical connector according to the second embodiment of the invention.

In FIG. 6, according to the second embodiment of the invention, the ground terminals 24 of the connector 20 are made integrally with the shield case 25. It is preferred that a slit is provided between the ground terminal 24 and the shield case 25 to facilitate the flexure of the ground terminal 24.

Figure 7:
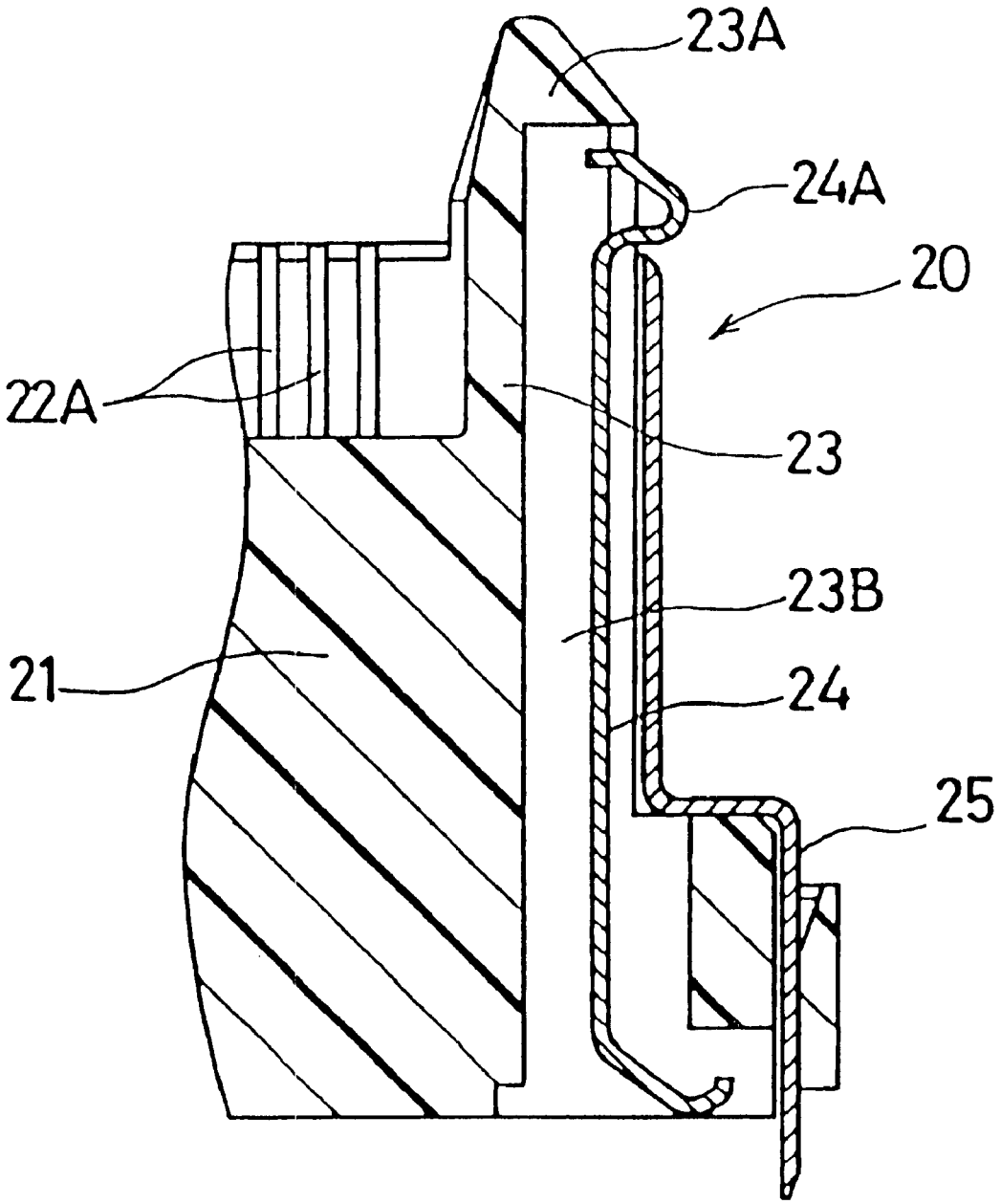
FIG. 7 is a sectional view of part of an electrical connector according to the third embodiment of the invention.

In FIG. 7, according to the third embodiment of the invention, the ground terminal 24 of the connector 20 is brought into spring contact with the circuit board P2 without soldering. It is press-fitted in the side recess 23B.

Figure 8:
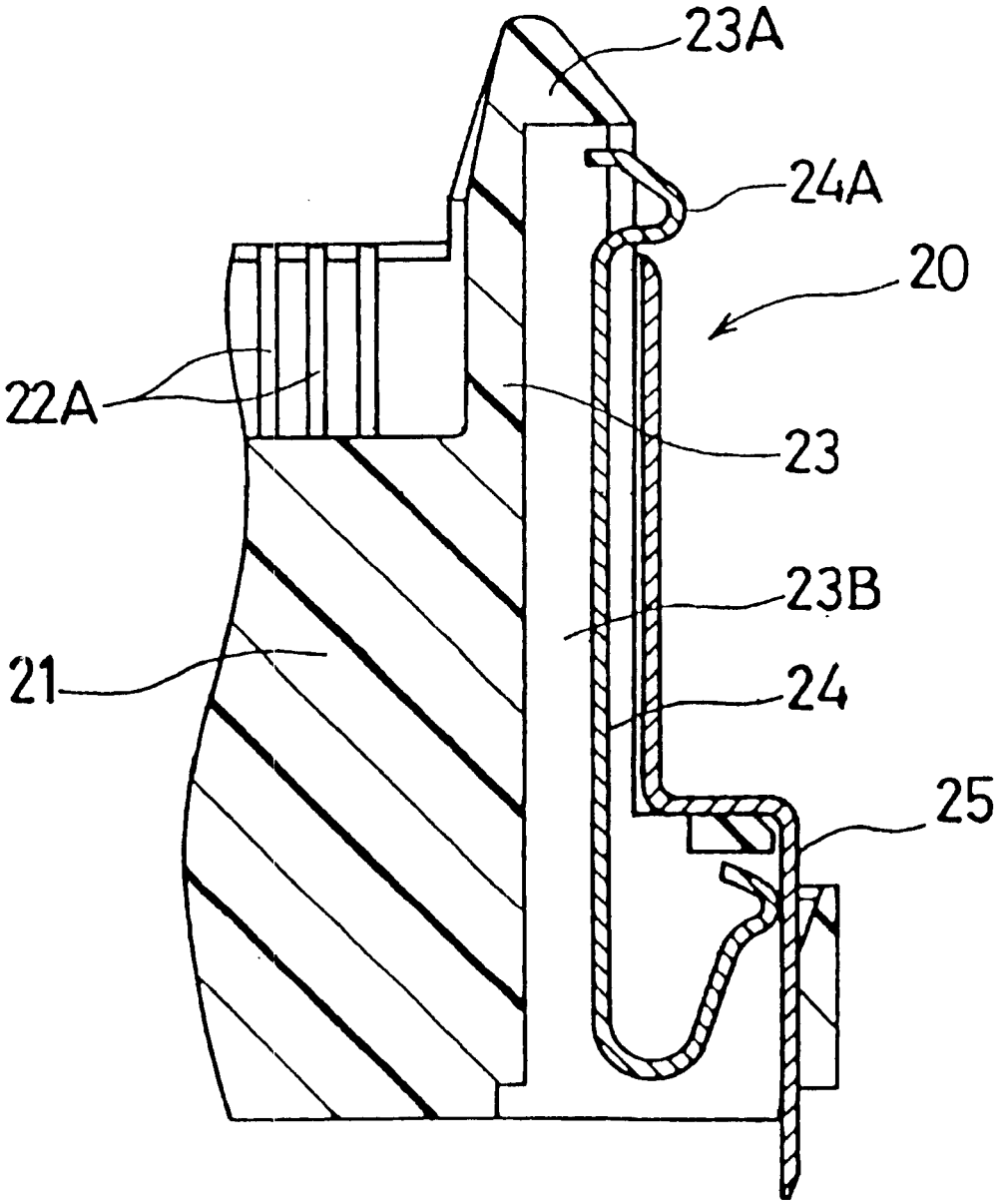
FIG. 8 is a sectional view of part of an electrical connector according to the fourth embodiment of the invention.

In FIG. 8, according to the fourth embodiment of the invention, the ground terminal 24 of the connector 20 press-fitted in the side recess 23B so as to make spring contact with the shield case 25.

Figure 9:
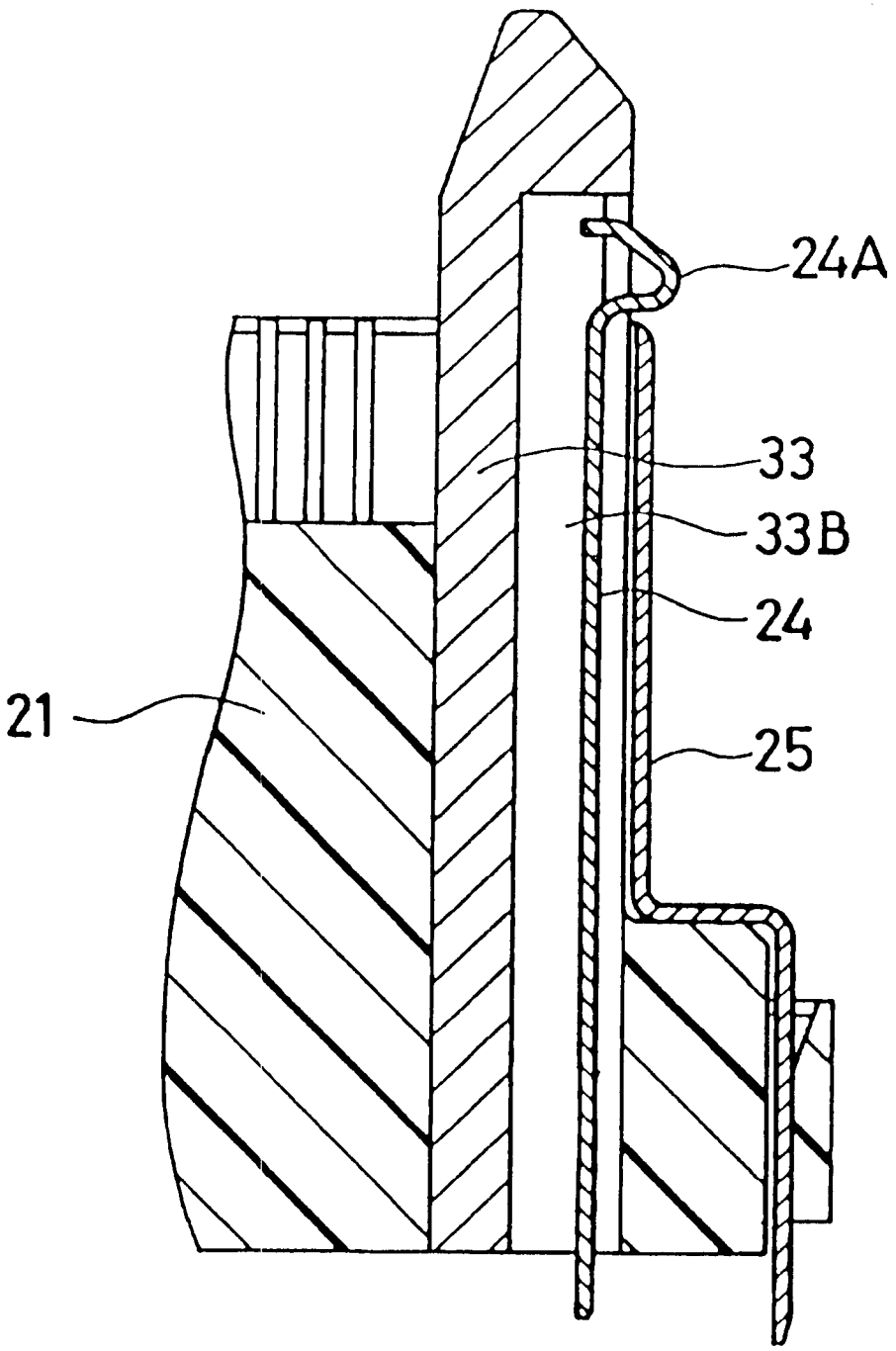
FIG. 9 is a sectional view of part of an electrical connector according to the fifth embodiment of the invention.

In FIG. 9, according to the fifth embodiment of the invention, the guiding column 33 is made of a metallic material separately from the housing 21. The ground terminal 24 is provided in the side recess 33B. This guiding column 33 is stronger than those of the above embodiments. It is press-fitted to the housing.

Figure 10:
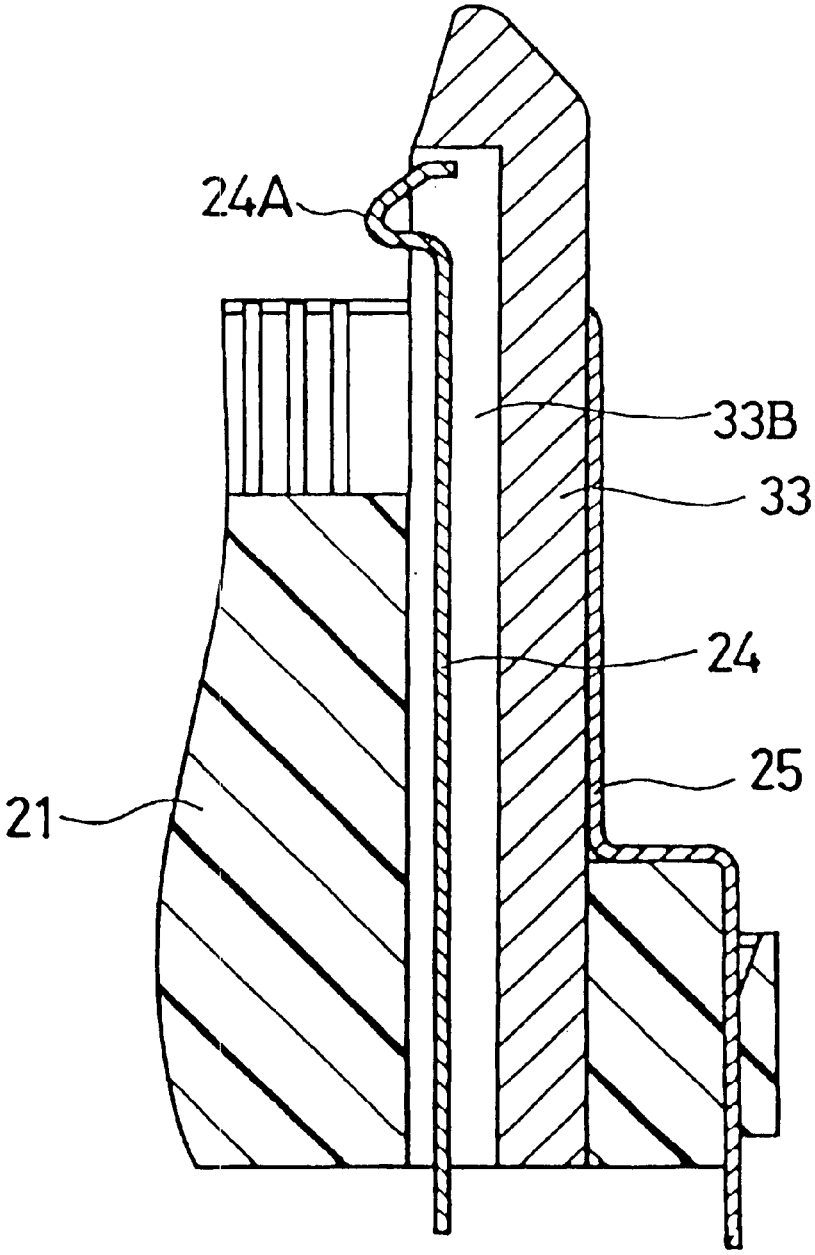
FIG. 10 is a sectional view of part of an electrical connector according to a modification to the fifth embodiment of the invention.

Alternatively, as shown in FIG. 10, the ground terminal 24 is provided in the side recess 33B opened in the direction opposite to that of FIG. 9.

Figure 11:
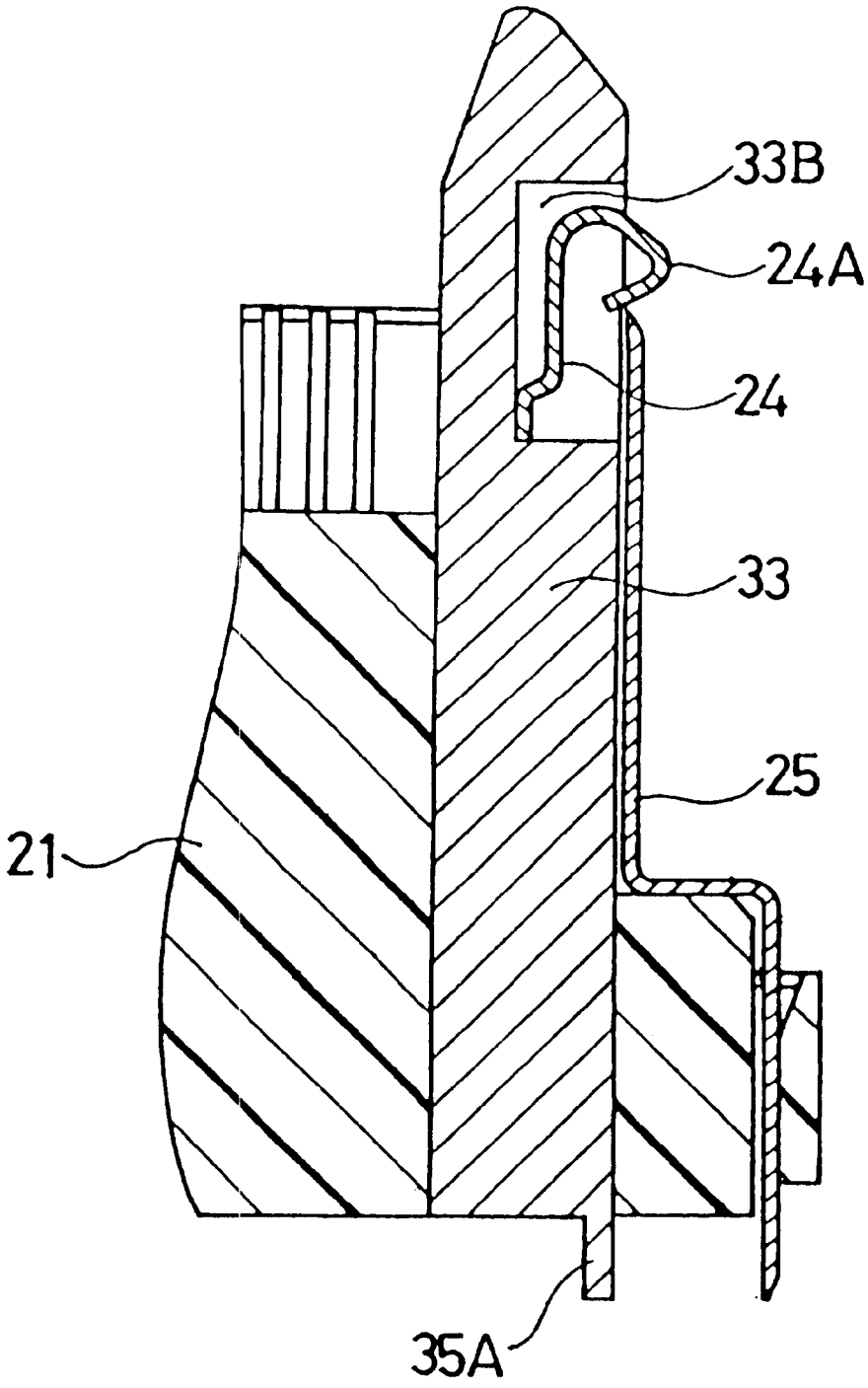
FIG. 11 is a sectional view of part of an electrical connector according to the second modification to the fifth embodiment of the invention.

As shown in FIG. 11, the ground terminal 24 is connected to the guiding column 33. The side recess 33B is made smaller than the above embodiments and the ground terminal 24 is welded to the guiding column 33 or press-fitted in the side recess 33B for electrical and mechanical connection. The guiding column 33 has a connection section 35A at the lower end.

Figure 12:
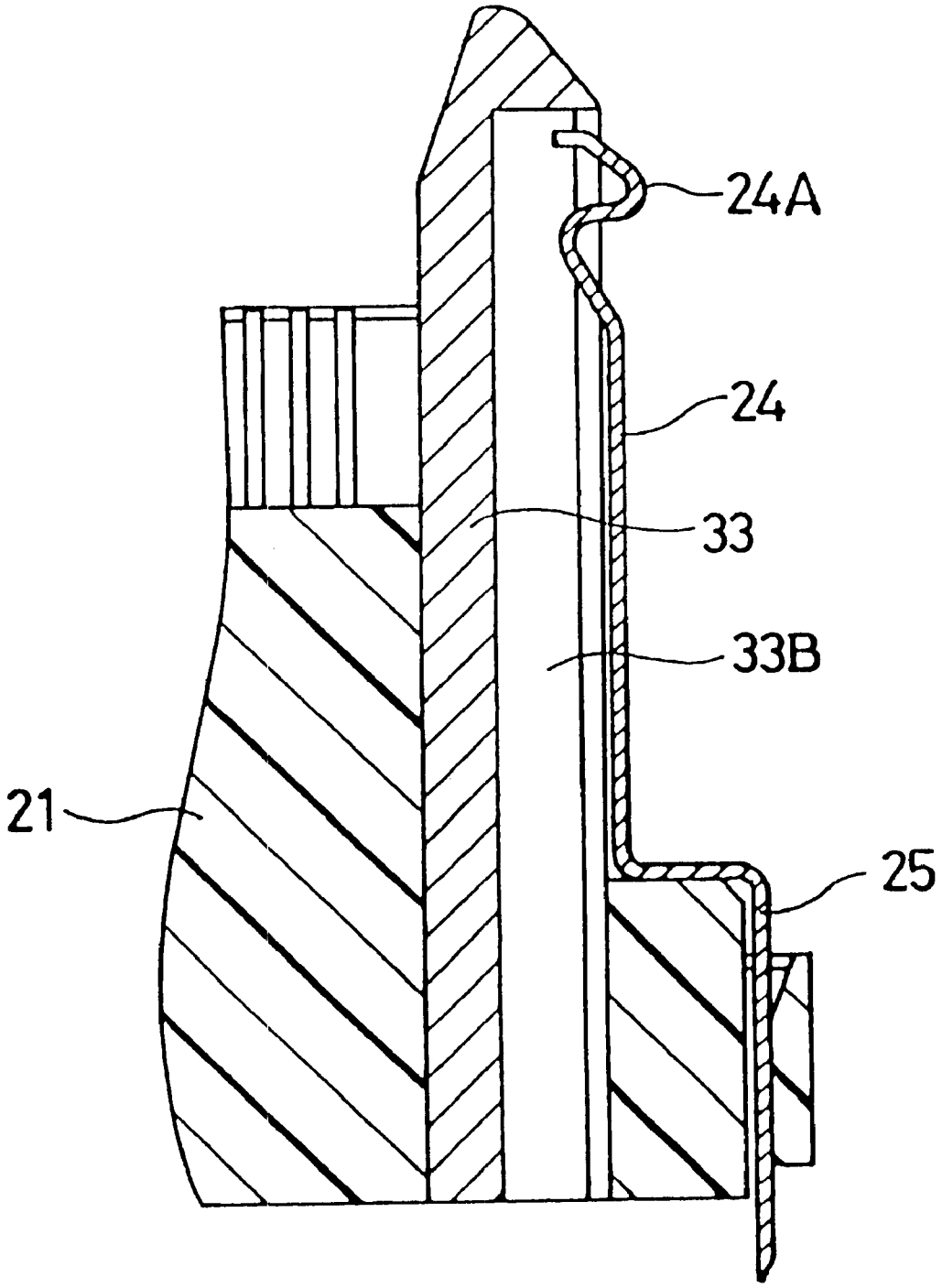
FIG. 12 is a sectional view of part of an electrical connector according to the sixth embodiment of the invention.

In FIG. 12, according to the sixth embodiment of the invention, the guiding column 33 is made of a metallic material and the ground terminal 24 is made integrally with the shield case 25.

Figure 13:
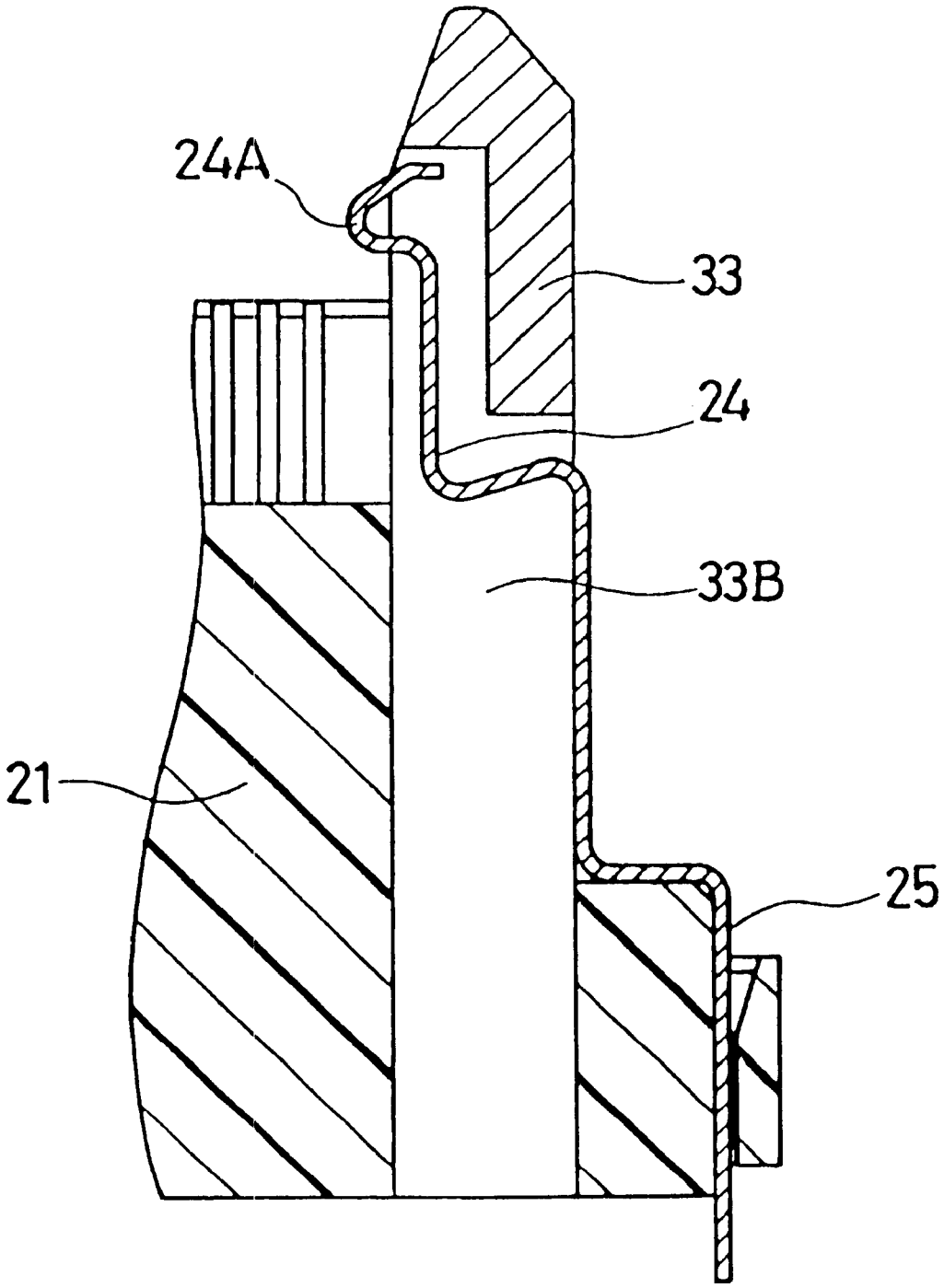
FIG. 13 is a sectional view of part of an electrical connector according to the seventh embodiment of the invention.
Figure 14:
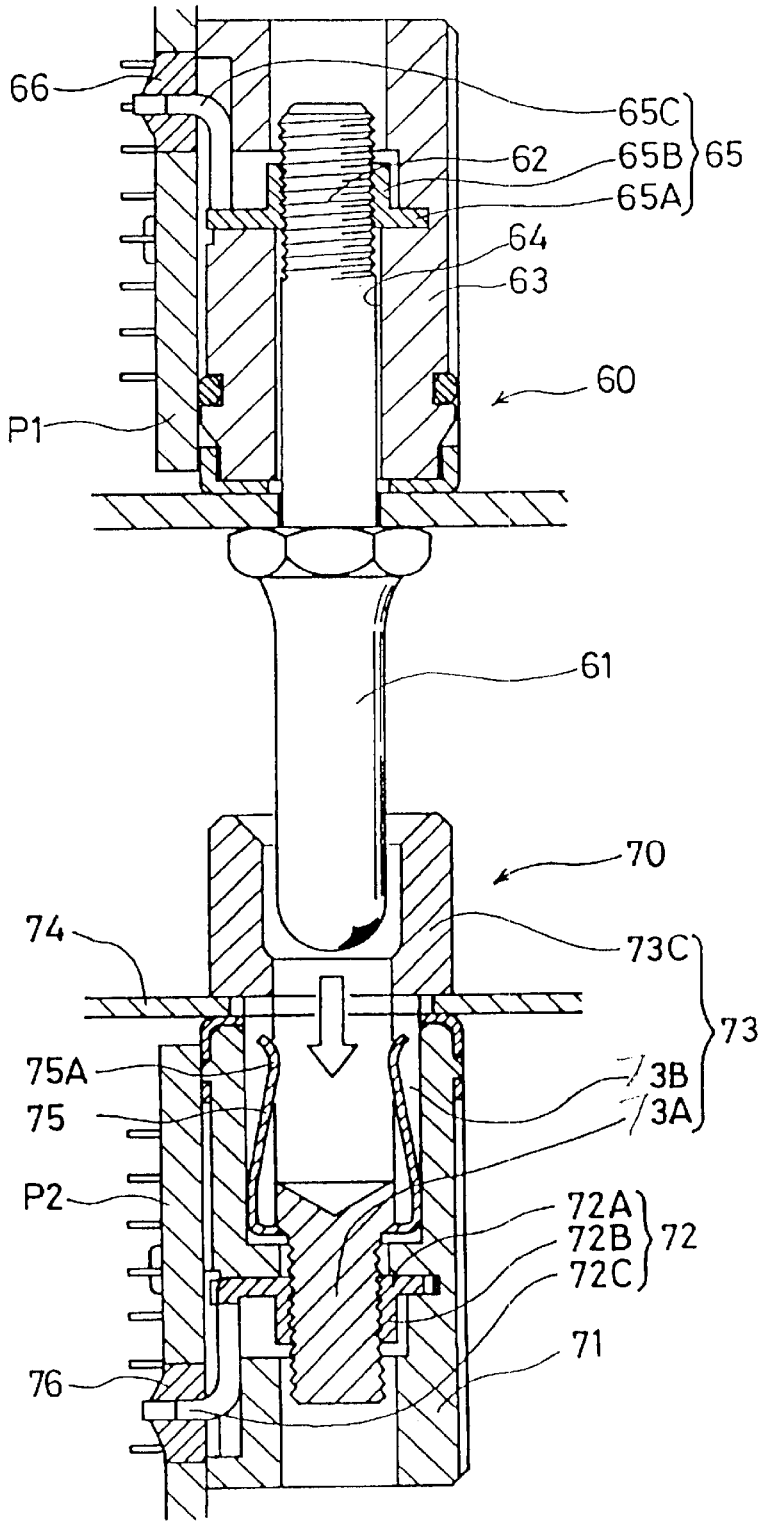
FIG. 14 PRIOR ART
FIG. 14 is a sectional view of conventional electrical connectors.

In FIG. 13, according to the seventh embodiment of the invention, the guiding column 33 is made of a metallic material and the ground terminal 24 is made of integrally with the shield case 25 and provided such that the contact section 24A faces inwardly.

As has been described above, according to the invention, the ground terminal is housed in the guiding column so that it is possible to provided a compact connector. Also, it is made of a metal strip so that the shield connection is made stable at low cost. Since the guiding column may be made integrally with the housing, it is possible to provide it close to the signal terminals for minimizing the connector. The ground terminal may be made integrally with the shield case to minimize the number of parts and assembling steps, making the structure simpler and the manufacturing cost lower than before.

Where the connector has a guiding aperture, the grounding member makes use of the thickness of a circuit board to increase the length of sliding on the contact section of a ground terminal for a mating connector so that it is possible to provide stable contact and contact of the ground terminal prior to the signal terminals.

What is claimed is:

1. An electrical connector comprising:

a housing;

at least one guiding column provided on a longitudinal end of said housing and extending forwardly from said housing to be inserted into a guiding aperture of a mating connector;

a side recess provided in said guiding column and having an opening on a side of said guiding column; and at least one ground terminal having a contact section and accommodated in said side recess such said contact section projects laterally from said opening of said recess for making sliding contact with a ground member of said mating connector.

2. The electrical connector according to claim 1, wherein said guiding column is made integrally with said housing as a unit and said ground terminal has a connection section at a rear end.

3. The electrical connector according to claimed 1, wherein said guiding column is made of a metallic material and supported by said housing so as to make contact with said ground terminal and has a connection section at a rear end thereof.

4. The electrical connector according to claim 1, which further comprises a shield case attached to said housing and made integrally with said ground terminal.

5. The electrical connector according to claim 3, which further comprises a shield case attached to said housing so as to make contact with said guiding column.

6. An electrical connector comprising:

a housing;

at least one guiding aperture provided in said housing and having an open bottom for receiving a guiding column of a mating connector;

a shield case provided outside said housing; and at least one ground member extending from said shield case into an inside wall of said guiding aperture for sliding contact with a ground terminal of said mating connector.

* * * * *